US005668361A

United States Patent [19]

Möncke et al.

[11] Patent Number: 5,668,361

[45] Date of Patent: Sep. 16, 1997

[54] VACUUM-TYPE CIRCUIT BREAKER WITH CONNECTION TERMINALS

[75] Inventors: Hartmut Möncke; Ibrahim Traore, both of Berlin, Germany

[73] Assignee: Siemens Aktiengesellschaft, München, Germany

[21] Appl. No.: 406,961

[22] PCT Filed: Aug. 13, 1993

[86] PCT No.: PCT/DE93/00739

§ 371 Date: May 4, 1995

§ 102(e) Date: May 4, 1995

[87] PCT Pub. No.: WO94/08347

PCT Pub. Date: Apr. 14, 1994

[30] Foreign Application Priority Data

Sep. 25, 1992 [DE] Germany ..... 9213143 U

[51] Int. Cl.[6] ..... H01H 33/66

[52] U.S. Cl. ..... 218/118; 218/123

[58] Field of Search ..... 200/50 R, 50 C; 218/1, 2, 7, 8, 10, 14, 118, 119, 120, 121, 123, 126, 127, 134, 139, 140, 146, 154, 155; 361/807, 809, 810, 837

[56] References Cited

U.S. PATENT DOCUMENTS 3,190,992 6/1965 Digby ..... 200/144

3,784,774 1/1974 Wilson ..... 200/144 B 4,434,331 2/1984 Sakuma et al. ..... 200/144 B 4,621,175 11/1986 Volkmar ..... 200/335

FOREIGN PATENT DOCUMENTS 0 450 397 10/1991 European Pat. Off. ..... H01H 33/02

OTHER PUBLICATIONS

Siemens Publication *"Vakuum-Hochspannungsschütze 3TL6"* (1988), Order No. E86010-K1802-A201-A1.

*Primary Examiner*—Michael L. Gellner
*Assistant Examiner*—Michael A. Friedhofer
*Attorney, Agent, or Firm*—Kenyon & Kenyon

[57] ABSTRACT

A vacuum contactor has one connection terminal for the upper and lower end of each vacuum interrupter. At least the upper connection terminal has a metal member that is dimensioned essentially as a function of a current to be carried. A separate holder of insulating material is used to join the metal member to wall parts of an insulator body that accommodates the vacuum interrupters. In this manner, the distance between live parts and grounded parts of the vacuum contactor is increased and the reliability with respect to protecting against partial discharges and breakdowns is improved.

10 Claims, 1 Drawing Sheet

VACUUM-TYPE CIRCUIT BREAKER WITH CONNECTION TERMINALS

BACKGROUND OF THE INVENTION

The invention relates to a vacuum contactor. More particularly, the invention relates to a vacuum contactor having at least one vacuum interrupter and a chamber open on one side for accommodating the insulator body which contains the vacuum interrupter, an upper and a lower connection terminal arranged on the insulator body as a connection between the vacuum interrupter and an external electric circuit, each of these connection terminals being secured to opposite wall parts of the insulator body, and having a connector contact face for an external conductor.

A vacuum contactor of this type is shown in the German company publication by Siemens entitled *Vakuumhochspannungsschutze* 3TL6 (High-Voltage Vacuum Contactors 3TL6), edition 1988, order No. E86010-K1802-A201-A1. It discloses connection terminals made of metal structural parts, which are used for both the current transfer and as means for mounting on the insulator body. An object of the present invention is to improve reliability in the protection against partial discharges and breakdowns in the area of the connection terminals.

SUMMARY OF THE INVENTION

This objective is solved in accordance with the invention in that the connector contact face of at least the upper connection terminal is a component of a metal member that is dimensioned essentially only as a function of a current to be carried and a holder made of insulating material to be joined to the wall parts of the insulator body is used to secure the metal member. In this manner, the high-voltage potential is kept further away from the grounded components than had been possible using existing structural parts of metal. Because of the increased distance, the electric field strength is reduced at critical points, so that the reliability with respect to protecting against breakdowns or partial discharges is improved. Although it is possible in principle to design both the upper as well as the lower connection terminal in the indicated manner, it is typically sufficient to only alter the upper connection terminal accordingly. Because of its increased dielectric strength, the vacuum contactor can be used in the case of unaltered dimensions for higher nominal voltages than had previously been possible.

The invention advantageously makes it possible for the partial area of the connection terminals used for current conduction to be simpler in design than in known methods. In particular, the metal member can have a rectangular cross-section and, the holder has a recess adapted to the cross-sectional shape of the metal member. Thus, the recess assumes the function of mutually aligning the metal member and the holder. For example, the metal member can be a mounting channel that is straight or right-angled at the end, or a cast part of copper with suitable surface protection.

The holder can have projections that protrude in the direction of the narrow sides of the metal member. In this case, the projections take over the task of aligning the metal member, while the remaining boundary surfaces of the recess of the holder can have a certain angle of inclination to facilitate manufacturing.

In addition, it is recommended that the holder have a stop face to delimit the recess in its longitudinal direction, as well as a cut-away opening for a fastening element that joins the metal member and the holder. Therefore, when joining together the metal member and the holder, both parts are positioned to align the cut-away opening of the holder with a corresponding cut-away opening in the metal member. This makes it possible for a clamping screw to be inserted to join together the metal member, the holder and a flexible conductor that is provided as a movable connection between the connection terminal and the movable terminal stud of the vacuum interrupter.

As with the connection terminals which are made entirely of metal, the holder which is made of insulating material for the upper connection terminal can have a fork-like design and can have two lateral sides to be joined to the opposite wall parts of the insulator body. A suitable clearance is provided between the two lateral sides of the upper connection terminal to allow passage of the movable terminal stud of the vacuum interrupter.

DETAILED DESCRIPTION

Figure 1:
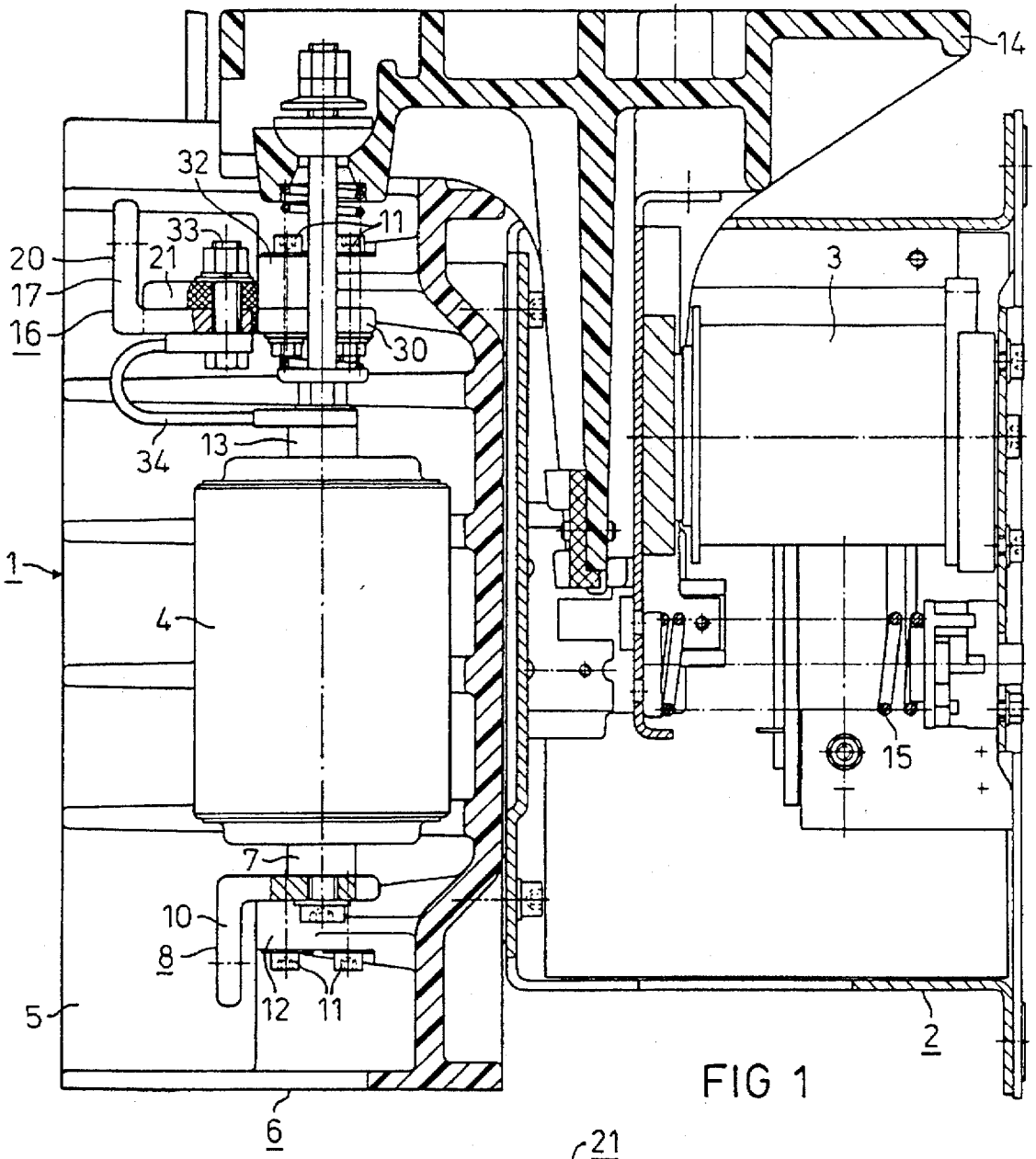
FIG. 1 is a partial cross section of the vacuum contactor of the present invention.

The vacuum contactor 1 of FIG. 1 comprises a drive assembly box 2 with a solenoid coil 3 for switching on and off a vacuum interrupter 4 which is located in a chamber 5 of an insulator body 6. The drive assembly box 2 and the insulator body 6 are securely joined to one another.

In the case of a multipole design, the insulator body 6 contains a number of chambers 5 that corresponds to the number of vacuum interrupters 4.

At its lower end in the area of its fixed terminal stud 7, the vacuum interrupter 4 is rigidly joined to a lower connection terminal 8, which has a metal member 10 and is secured by screws 11 to wall parts 12 of the insulator body 6. In the sectional view of FIG. 1, only one of the opposite wall parts 12 is visible. At its end facing opposite the connection terminal 8, the vacuum interrupter 4 is coupled via its movable terminal stud 13 to a rocker-type operating lever 14, which bears an armature that interacts with the solenoid coil 3. In the illustrated open-circuit condition, the vacuum interrupter 4 is held against the external air pressure acting on it by a tripping spring 15, which is likewise situated in the drive assembly box 2.

Figure 2:
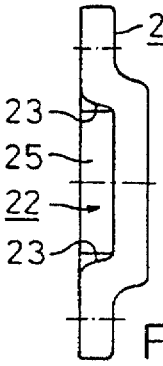
FIGS. 2 and 3 depict a support of a connection terminal in a front view, and a view of the bottom side respectively.
Figure 3:
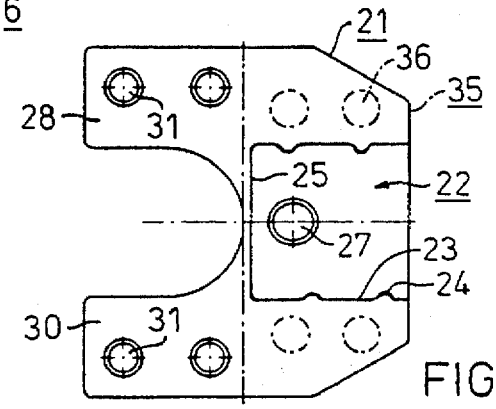
Figure 4:
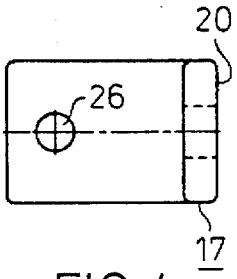
FIG. 4 shows a top view of a metal member having a connector contact face.

An upper connection terminal 16 likewise has a metal member 17 with a connector contact face 20. In addition, a holder 21 is provided, to which the metal member 17 is secured. Details with respect to these parts are given below with the description of FIGS. 2, 3 and 4. FIGS. 2 and 3 depict a front view and a bottom view, respectively of the holder 21. As these Figures show, the holder 21 which is made of an insulating material has a recess 22, which corresponds with a certain oversize tolerance to the width of the metal member 17. The wall surfaces 23 of the recess 22 are formed as chamfered and rounded off surfaces so as to allow the holder 21 to be advantageously manufactured as a plastic molded part. Projections 24 protruding in the direction of the narrow sides of the metal member are provided to align the metal member 17 in the recess 22. In addition, the recess 22 is delimited in the longitudinal direction by a stop face 25. A cut-away opening 26 (FIG. 4) provided in the metal member 20 and a corresponding cut-away opening 27 in the holder 21 thus come into alignment when the metal member 17 is inserted in the recess 22 up to the limit stop on the stop face 25. The parts then assume the position as is shown in FIG. 1.

As shown in FIG. 3, the holder 21 has a more or less fork-shaped design with two lateral sides 28 and 30, each comprising two pass-through openings 31 for fixing screws. The holder 21 abuts with lateral sides 28 and 30 on wall parts 32 in the upper area of the insulator body 6, only the lateral side 30 of the holder 21 being visible in FIG. 1. Screws 11 are used to secure the holder 21 to the wall parts 32. An assembly screw 33 joins together the metal member 17, the holder 21 and a flexible current conductor 34. The other end of the flexible current conductor 34 is connected to the movable terminal stud 13 of the vacuum interrupter 4.

The construction of the metal member 17 is advantageously simple and easy, as it is essentially designed for its task as a current-conducting connection member. The metal member 17 is designed as an angular cast piece of copper with suitable surface protection. Also, the holder 21 is an insulating mounting part, which can likewise be manufactured economically, for example, as a plastic injection molded part. In comparison to a connection terminal made only of metal, the high-voltage potential at the upper end of the vacuum interrupter 4 is not carried as far in the direction of the metal, grounded drive assembly box 2. The dielectric loading of the insulator body 6 in this region is, therefore, reduced in comparison to this known design.

Analogously, the lower connection terminal 8 can be made of a metal member used for current conduction and an insulating holder, the recess of the holder having the above described features. A holder of this type does not need fork-shaped lateral sides, because the fixed terminal stud 7 fits on the metal member and, therefore, does not pass through the holder. In FIG. 3, a dot-dash line indicates that the right part of the depicted holder can be used as a holder 35 for the lower connection terminal 8. Openings 36 drawn with a dot-dash line are provided for the lower fixing screws 11.

We claim:

1. A vacuum contactor comprising:

at least one vacuum interrupter;

a chamber being open on a first side, such that said vacuum interrupter is contained in an insulator body located in the first side of said chamber;

an upper connection terminal including a metal member;

a lower connection terminal;

each one of said upper and lower connection terminals being secured to wall parts of said insulator body, the wall parts being arranged on opposite sides of the vacuum interrupter, each one of said upper and lower connection terminals having a corresponding connector contact face for coupling to an external conductor such that each one of said upper and lower connection terminals is coupled between said vacuum interrupter and an external electric circuit, the connector contact face of at least the upper connection terminal being dimensioned as a function of a current to be carried in said vacuum contactor; and a holder made of an insulating material for attaching to at least one of the wall parts of said insulator body, said holder securing said metal member in said insulator body.

2. The vacuum contactor of claim 1 wherein said metal member has a rectangular cross-section and said holder has a recess having a cross-sectional shape substantially similar to the rectangular cross-section of the metal member.

3. The vacuum contactor of claim 2 wherein said metal member has narrow side surfaces and said holder includes projections protruding into the recess toward the narrow side surfaces of said metal member.

4. The vacuum contactor of claim 2 wherein said holder includes a stop face, said stop face delimiting a longitudinal extent of the recess, said holder also including a cut-away opening, such that a fastening element is inserted into said cut-away opening to join said metal member and said holder.

5. The vacuum contactor of claim 3 wherein said holder includes a stop face, said stop face delimiting a longitudinal extent of the recess in, said holder also including a cut-away opening, such that a fastening element is inserted into said cut-away opening to join said metal member and said holder.

6. The vacuum contactor of claim 1 wherein said holder has a fork-like design including two lateral sides which are joined to said opposite wall parts of the insulator body, such that a clearance exists between said lateral sides to allow passage a movable terminal stud of said vacuum interrupter.

7. The vacuum contactor of claim 2 wherein said holder has a fork-like design including two lateral sides which are joined to said opposite wall parts of the insulator body, such that a clearance exists between said lateral sides to allow passage a movable terminal stud of said vacuum interrupter.

8. The vacuum contactor of claim 3 wherein said holder has a fork-like design including two lateral sides which are joined to said opposite wall parts of the insulator body, such that a clearance exists between said lateral sides to allow passage a movable terminal stud of said vacuum interrupter.

9. The vacuum contactor of claim 4 wherein said holder has a fork-like design including two lateral sides which are joined to said opposite wall parts of the insulator body, such that a clearance exists between said lateral sides to allow passage a movable terminal stud of said vacuum interrupter.

10. The vacuum contactor of claim 5 wherein said holder has a fork-like design including two lateral sides which are joined to said opposite wall parts of the insulator body, such that a clearance exists between said lateral sides to allow passage a movable terminal stud of said vacuum interrupter.

* * * * *